US005466136A

United States Patent [19]

Yamada et al.

[11] Patent Number: 5,466,136

[45] Date of Patent: Nov. 14, 1995

[54] SCROLL COMPRESSOR HAVING A GAS LIQUID SEPARATOR

[75] Inventors: Sadayuki Yamada, Ootsu; Shigeru Muramatsu, Kusatsu; Takeshi Hashimoto, Kyoto; Hiroyuki Fukuhara, Ootsu, all of Japan

[73] Assignee: Matsushita Electric Industrial Co., Ltd., Osaka, Japan

[21] Appl. No.: 233,799

[22] Filed: Apr. 26, 1994

[30] Foreign Application Priority Data

Apr. 26, 1993 [JP] Japan ..... 5-099172

[51] Int. Cl.[6] ..... F01C 1/04

[52] U.S. Cl. ..... 418/55.6; 418/DIG. 1

[58] Field of Search ..... 418/55.6, 47, 181, 418/89, DIG. 1

[56] References Cited

U.S. PATENT DOCUMENTS

| | | | |
|---|---|---|---|
| 4,343,599 | 8/1982 | Kousokabe | 418/55.6 |
| 5,037,278 | 8/1991 | Fujio et al. | 418/55.6 |
| 5,286,179 | 2/1994 | Forni et al. | 418/55.6 |

FOREIGN PATENT DOCUMENTS

| | | | |
|---|---|---|---|
| 29979 | 1/1990 | Japan . | |
| 5005486 | 1/1993 | Japan | 418/55.6 |
| 5223074 | 8/1993 | Japan | 418/55.6 |

*Primary Examiner*—Richard A. Bertsch
*Assistant Examiner*—Charles G. Freay
*Attorney, Agent, or Firm*—Lowe, Price, LeBlanc & Becker

[57] ABSTRACT

A scroll compressor has a closed container 1 with a bottom serving as an oil storage 10 reserving lubricating oil 9. A gas-liquid separator 28 is provided near the closed container 1. An intake pipe 23 is connected to an upper end of the gas-liquid separator 28. An intake gas connecting pipe 29 extends normal to the axial direction of the gas-liquid separator 28 to connect the upper part of the gas-liquid separator 28 with the closed container 1. Meanwhile, a connecting pipe 24 is provided to connect the bottom of the gas-liquid separator 28 with the oil storage 10 in the closed container 1. Furthermore, there in provided a filter 30 between the intake pipe 23 and the intake gas connecting pipe 29. Thus, oil amount introduced into the compressor is reduced. Reliability is increased, and efficiency of air-conditioning apparatus is improved.

6 Claims, 3 Drawing Sheets

SCROLL COMPRESSOR HAVING A GAS LIQUID SEPARATOR

BACKGROUND OF THE INVENTION

1. Field of the Invention

The present invention relates to a scroll compressor used for air-conditioning apparatus for home or business use and other devices.

2. Background of the Related Art

FIG. 3 is a vertical cross-sectional view showing a conventional scroll compressor of low pressure type.

A closed container 1 has an upper part accommodating a compressor mechanism 2 including a stationary scroll 2*a*, a movable scroll 2*b* meshing with the stationary scroll 2*a* to cause an eccentric revolving motion with respect to this stationary scroll 2*a*, a thrust bearing 3 supporting the movable scroll 2*b*, and a bearing member 4 supporting the thrust bearing 3. A shaft 2*c* of the movable scroll 2*b* is inserted into an eccentric bearing 6 in a bore 5*b* provided at an end portion 5*a* of a crank shaft 5. Thus, a rotational motion of the crank shaft 5 is converted into an eccentric revolving motion of the movable scroll 2*b*. The crank shaft 5 is associated with an electric motor 7 disposed under the bearing member 4. More specifically, the electric motor 7 includes a rotor 7*a* connected with the crank shaft 5 and a stator 7*b* secured, by shrinkage fitting, to the inside surface of the closed container 1. The crank shaft 5 is supported by a main bearing 8*a* and an auxiliary bearing 8*b* of the bearing member 4. The closed container 1 has a lower bottom serving as an oil storage 10 reserving lubricating oil 9. Also, the closed container 1 has a side wall on which an intake pipe 23 is installed. According to this structure, the oil storage 10 is subjected to gas pressure of intake side. The bearing member 4 has an oil discharge port 12 allowing the lubricating oil 9 to return the oil storage 10 after lubricating and cooling various components including the main bearing 8*a*, the auxiliary bearing 8*b*, the eccentric bearing 6, and the thrust bearing 3. The crank shaft 5 has an eccentric through hole 13 supplying the lubricating oil 9 to various bearing portions, such as the main bearing 8*a*, the auxiliary bearing 8*b*, the eccentric bearing 6, and the thrust bearing 3. Furthermore, the crank shaft 5 has a lower end connected with an oil guide 14 by press-fitting or shrinkage-fitting to suck up the lubricating oil 9. An outlet chamber 15, provided between an upper shell 1*a* constituting a part of the closed container 1 and the stationary scroll 2*a*, temporarily reserves gas compressed by the compressor mechanism 2 so as to qualify as an outlet muffler. An outlet pipe 16 is provided to discharge the compressed gas out of the closed container 1. A spacer 17 partitions the inside space of the closed container i so that high-pressure gas in the outlet chamber 15 is separated from low-pressure gas acting on the oil storage 10. Through this spacer 17, the stationary scroll 2*a* and the bearing member 4 are connected with each other by means of bolts. This spacer 17 has an outer peripheral end welded to the inside surface of the closed container 1. The stator 7*a* has an oil return passage 18 allowing the lubricating oil 9 discharged from the oil discharge port 12 to return the oil storage 10. A reference numeral 19 represents a check valve preventing the movable scroll 2*b* from causing a reverse rotation in its stop condition. A reference numeral 20 represents an Oldham's ring preventing autorotation and causing the movable scroll 2*b* to revolve eccentrically with respect to the stationary scroll 2*a*. A reference numeral 21 represents an intake port provided on the bearing member 4 to introduce low-pressure gas into the compressor mechanism 2. This intake port 21 is placed in the vicinity of the intake pipe 23 connected to the side wall of the closed container 1.

Next, an operation of the above-described compressor will be explained.

Low-pressure cooling medium enters into the closed container 1 through the intake pipe 23. A part of the low-pressure cooling medium cools the electric motor 7 and is introduced into the compressor mechanism 2 from the intake port 21 of the bearing member 4. Revolving motion of the movable scroll 2*b* with respect to the stationary scroll compresses the gas introduced in the compressor mechanism thereby supplying high-pressure gas to the outlet chamber 15. Thereafter, the compressed gas goes out of the closed container 1 through the outlet pipe 16. After circulating in the refrigerating passage of an air-conditioner, the gas returns to the compressor from the intake pipe 23 so as to realize a well-known refrigerating cycle.

Meanwhile, the lubricating oil 9 is sucked up through the oil guide 14 and then escalated through the eccentric through hole 13 of the crank shaft 5 due to centrifugal force. A part of the lubricating oil 9 is used to lubricate and cool the auxiliary bearing 8*b* and goes to the oil discharge port 12. Most of the lubricating oil 9 proceeds to the eccentric bearing 6, the thrust bearing 3 and the main bearing 8*a* successively and is merged into the flow of the lubricating oil 9 coming from the auxiliary bearing 8*b*, subsequently going out of the oil discharge port 12 on the stator 7*b* and returning the oil storage 10 through the oil return passage 18 thus constituting a lubricating cycle. In this lubricating cycle a part of the lubricating oil 9 enters, after lubricating the thrust bearing 3, into the compressor mechanism 2 to seal the compressor mechanism 2 and is discharged together with compression gas into the outlet chamber 15.

In such a low-pressure scroll compressor, the lubricating oil 9 entered into the compressor mechanism 2 is discharged into the outlet chamber 15 and sent out of the closed container 1 through the outlet pipe 16. Then, after circulating through the refrigerating cycle, the oil returns to the closed container 1 from the intake pipe 23. Some of the returning oil falls into the oil storage 10 due to gravity, however most is again introduced into the compressor mechanism 2 through the intake port 21 located nearly to the intake pipe 23. This necessitates supply of additional lubrication oil. If such a cycle is repeated, the total amount of lubricating oil consumed, i.e., a summation of original oil and newly added oil, will increase synergistically. It is normally believed that the layout of providing the intake port 21 of the compressor mechanism 2 closely to the intake pipe 23 is advantageous in preventing intake gas from being excessively heated by the electric motor 7. However, this layout is disadvantageous in view of the resulting unexpected increase of lubricating oil since very little oil can return to the oil storage 10 due to natural fall by gravity. In fact, almost all the lubricating oil 9 returned from the intake pipe 23 is directly introduced into the compressor mechanism 2 without returning to the oil storage 10, resulting in reduction of oil amount in the oil storage 10. With reducing oil amount of the oil storage 10, the lubricating oil 9 supplied to various frictional parts decreases proportionally, accompanied by declined reliability. Furthermore, increase of oil introduced into the refrigerating cycle has an adverse effect on the heat exchanger and, therefore, refrigerating ability and efficiency of an air-conditioning apparatus will decrease.

SUMMARY OF THE INVENTION

Accordingly, in view of above-described problems encountered in the prior art, a principal object of the present invention is to provide a scroll compressor capable of suppressing the oil amount wasted, improving refrigerating ability and efficiency of an air-conditioning apparatus, and thereby increasing reliability.

In order to accomplish the above purposes, a first aspect of the present invention provides a scroll compressor comprising: a closed container accommodating compressor means; said compressor means including a stationary scroll, a movable scroll meshing with said stationary scroll, a crank shaft causing an eccentric revolving motion of said movable scroll with respect to said stationary scroll, and bearing means supporting said crank shaft; an electric motor associated with said crank shaft, said electric motor including a rotor connected with said crank shaft and a stator secured to said closed container; an oil storage provided at a lower part of said closed container for reserving lubricating oil; a gas-liquid separator connected to said closed container; an intake gas connecting pipe having one end connected to said closed container at a position spaced from the lower part of the closed container and the other end connected to said gas-liquid separator; and a connecting pipe having one end connected to a bottom part of said gas-liquid separator and the other end connected to the vicinity of said oil storage.

In the above first aspect of the present invention, it is preferable that said one end of the intake gas connecting pipe is disposed close to an intake port of said compressor means, and the other end of the connecting pipe is disposed close to said electric motor.

A second aspect of the present invention provides a scroll compressor comprising: a closed container accommodating compressor means; said compressor means including a stationary scroll, a movable scroll meshing with said stationary scroll, a crank shaft causing an eccentric revolving motion of said movable scroll with respect to said stationary scroll, and bearing means supporting said crank shaft; an electric motor associated with said crank shaft, said electric motor including a rotor connected with said crank shaft and a stator secured to said closed container; an oil storage provided at a lower part of said closed container for reserving lubricating oil; a gas-liquid separator provided parallel to said closed container; an intake pipe connected to an upper end of said gas-liquid separator along an axial direction of said gas-liquid separator; an intake gas connecting pipe having one end connected to said closed container at a portion spaced from the lower part of said closed container and the other end connected to an upper part of said gas-liquid separator, said intake gas connecting pipe extending perpendicularly to the axial direction of said gas-liquid separator; and a connecting pipe having one end connected to a bottom part of said gas-liquid separator and the other end connected to the vicinity of said oil storage.

A third aspect of the present invention provides a scroll compressor comprising: a closed container accommodating compressor means; said compressor means including a stationary scroll, a movable scroll meshing with said stationary scroll, a crank shaft causing an eccentric revolving motion of said movable scroll with respect to said stationary scroll, and bearing means supporting said crank shaft; an electric motor associated with said crank shaft, said electric motor including a rotor connected with said crank shaft and a stator secured to said closed container; an oil storage provided at a lower part of said closed container for reserving lubricating oil; a gas-liquid separator provided parallel to said closed container; an intake pipe connected to an upper end of said gas-liquid separator; an intake gas connecting pipe having one end connected to said closed container at a position spaced from the lower part of said closed container and the other end connected to said gas-liquid separator; and a filter provided between said intake pipe and said intake gas connecting pipe.

A fourth aspect of the present invention provides a scroll compressor comprising: a closed container having an upper part accommodating compressor means; said compressor means including a stationary scroll, a movable scroll meshing with said stationary scroll, a crank shaft causing an eccentric revolving motion of said movable scroll with respect to said stationary scroll, and bearing means supporting said crank shaft; said closed container having a lower part accommodating an electric motor associated with said crank shaft, said electric motor including a rotor connected with said crank shaft and a stator secured to said closed container; an oil storage provided at the lower part of said closed container for reserving lubricating oil; a gas-liquid separator fixed to said closed container, said gas-liquid separator having an inner pipe opened to an upper part of said gas-liquid separator; an intake gas connecting pipe having one end connected to said closed container at a portion spaced from the lower part of said closed container and the other end connected to the inner pipe of said gas-liquid separator; a connecting pipe having one end connected to a bottom part of said gas-liquid separator and the other end connected to vicinity of said oil storage.

BRIEF DESCRIPTION OF THE DRAWINGS

The above and other objects, features and advantages of the present invention will become more apparent from the following detailed description which is to be read in conjunction with the accompanying drawings, in which.

DETAILED DESCRIPTION OF THE PREFERRED EMBODIMENTS

Hereinafter, preferred embodiments of the present invention will be explained in detail with reference to the accompanying drawings.

Figure 1:
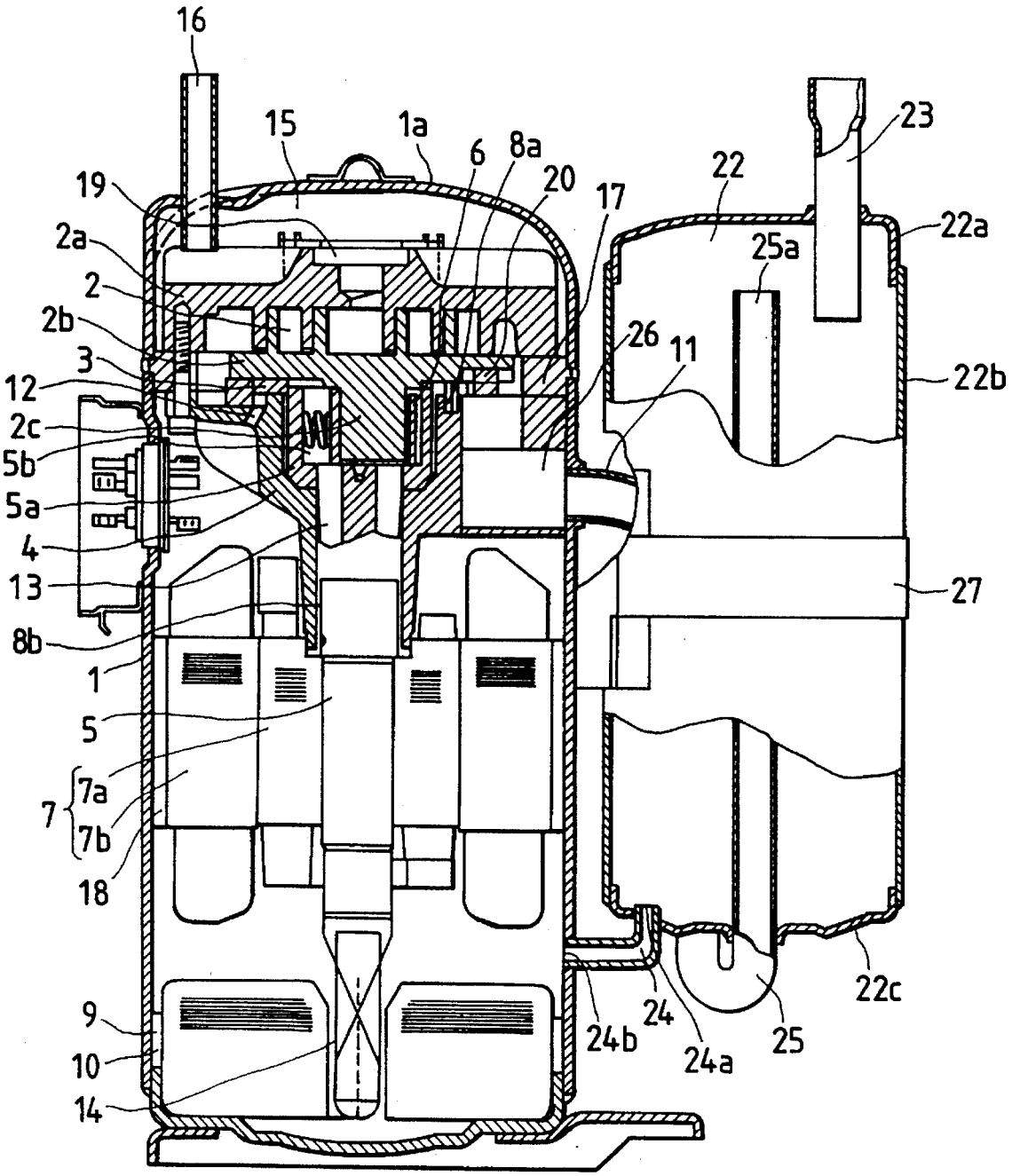
FIG. 1 is a vertical cross-sectional view showing one embodiment of a scroll compressor in accordance with the present invention.

FIG. 1 is a low-pressure type scroll compressor in accordance with a preferred embodiment of the present invention. A closed container 1 has an upper part accommodating a compressor mechanism 2 including a stationary scroll 2*a*, a movable scroll 2*b* meshing with this stationary scroll 2*a* so as to cause an eccentric revolving motion with respect to this stationary scroll 2*a*, a thrust bearing 3 supporting the movable scroll 2*b*, and a bearing member 4 supporting the thrust bearing 3. A shaft 2*c* of the movable scroll 2*b* is inserted into an eccentric bearing 6 in a bore 5*b* provided at an end portion 5*a* of a crank shaft 5. Thus, a rotational motion of the crank shaft 5 is converted into an eccentric revolving motion of the movable scroll 2*b*. The crank shaft 5 is associated with an electric motor 7 disposed under the bearing member 4. More specifically, the electric motor 7 includes a rotor 7*a* connected with the crank shaft 5 and a stator 7*b* secured, by shrinkage fitting, to the inside surface of the closed container 1. The crank shaft 5 is supported by a main bearing 8*a* and an auxiliary bearing 8*b* of the bearing member 4.

The closed container 1 has a lower bottom serving as an oil storage 10 reserving lubricating oil 9. Also, the closed container 1 has a side wall on which an intake gas connecting pipe 11 is installed. According to this structure, the oil storage 10 is subjected to gas pressure of intake side. The bearing member 4 has an oil discharge port 12 allowing the lubricating oil 9 to return the oil storage 10 after lubricating and cooling various components including the main bearing 8*a*, the auxiliary bearing 8*b*, the eccentric bearing 6, and the thrust bearing 3. The crank shaft 5 has an eccentric through hole 13 supplying the lubricating oil 9 to various bearing portions, such as the main bearing 8*a*, the auxiliary bearing 8*b*, the eccentric bearing 6, and the thrust bearing 3. Furthermore, the crank shaft 5 has a lower end connected with an oil guide 14 by press-fitting or shrinkage-fitting to suck up the lubricating oil 9.

An outlet chamber 15, provided between an upper shell 1*a* constituting a part of the closed container 1 and the stationary scroll 2*a*, temporarily reserves gas compressed by the compressor mechanism 2 so as to qualify as an outlet muffler. An outlet pipe 16 is provided to discharge the compressed gas out of the closed container 1. A spacer 17 partitions the inside space of the closed container 1 so that high-pressure gas in the outlet chamber 15 is separated from low-pressure gas acting on the oil storage 10. Through this spacer 17, the stationary scroll 2*a* and the bearing member 4 are connected with each other by means of bolts. This spacer 17 has an outer peripheral end welded to the inside surface of the closed container 1. The stator 7*a* has an oil return passage 18 allowing the lubricating oil 9 discharged from the oil discharge port 12 to return to the oil storage 10. A reference numeral 19 represents a check valve preventing the movable scroll 2*b* from causing a reverse rotation in its stop condition. Reference numeral 20 represents an Oldham's ring preventing autorotation and causing the movable scroll 2*b* to revolve eccentrically with respect to the stationary scroll 2*a*. Reference numeral 26 represents an inlet chamber provided in the bearing member 4 so as to be spatially separated from the oil storage 10 for allowing the compressor mechanism 2 to suck low-pressure gas from a gas-liquid separator 22.

The intake gas connecting pipe 11 is positioned to open to the inlet chamber 26. The gas-liquid separator 22 is a closed container comprising a body shell 22*b*, an upper end plate 22*a* and a lower end plate 22*c*. An intake pipe 23 is connected to the upper end plate 22*a*, while an inner pipe 25 is installed on the lower end plate 22*c*. The inner pipe 25 extends vertically from the lower end plate 22*c* toward the upper end plate 22*a* so that a distal opening 25*a* of the inner pipe 25 is positioned in the upper part of the gas-liquid separator 22. The other end of the inner pipe 25 is extracted out of the gas-liquid separator 22 and is connected with the intake gas connecting pipe 11. Furthermore, there is provided a connecting pipe 24, one end of which has an opening 24*a* communicating with the lower part of the gas-liquid separator 22 and the other end of which has an opening 24*b* communicating with the lower part of the closed container 1 just above the oil storage 10 and in the vicinity of the electric motor 7. The gas-liquid separator 22 itself is fixed with the closed container 1 by means of a band 27 or the like.

Next, the operation and function of the above-described compressor are both explained below in detail.

The above-described compressor is a device functionally constituting an essential part of a well-known refrigerating cycle (not shown). After returning from an evaporator in the refrigerating cycle, low-pressure cooling medium enters into the gas-liquid separator 22 through the intake pipe 23 and then, passes through the intake gas connecting pipe 11 before entering the closed container 1. (Details of the gas-liquid separator 22 will be described later)

As the intake gas connecting pipe 11 directly opens to the inlet chamber 26, cooling medium is guided into the compressor mechanism 2 without being subjected to heat radiation from the electric motor 7. Eccentric revolving motion of the movable scroll 2*b* with respect to the stationary scroll 2*a* compresses the gas introduced in the compressor mechanism 2, thereby supplying high-pressure gas to the outlet chamber 15. Thereafter, the compressed gas goes out of the closed container 1 through the outlet pipe 16. After being circulated via the refrigerating passage, the condenser and the evaporator of an air-conditioner, the gas returns from the intake pipe 23 so as to constitute a well-known refrigerating cycle.

Meanwhile, the lubricating oil 9 is sucked up through the oil guide 14 and then escalated through the eccentric through hole 13 of the crank shaft 5 due to centrifugal force. A part of the lubricating oil 9 is used to lubricate and cool the auxiliary bearing 8*b* and goes to the oil discharge port 12. Most of the lubricating oil 9 proceeds to the eccentric bearing 6, the thrust bearing 3 and the main bearing 8*a* successively and is merged into the flow of the lubricating oil 9 coming from the auxiliary bearing 8*b*, subsequently going out of the oil discharge port 12, falling on the stator 7*b* and returning the oil storage 10 through the oil return passage 18 thus constituting a lubricating cycle. In this lubricating cycle a part of the lubricating oil 9 enters, after lubricating the thrust bearing 3, into the compressor mechanism 2 to seal the compressor mechanism 2 and is discharged together with compression gas into the outlet chamber 15.

Gas cooling medium and the lubricating oil 9 sent out of the closed container 1 through the outlet pipe 16 circulate through the refrigerating cycle and enter the gas-liquid separator 22, wherein lubricating oil 9 is separated from gas cooling medium due to difference of specific gravity. More specifically, the lubricating oil 9 is a liquid component which falls and settles in the bottom of the gas-liquid separator 22 due to its large specific gravity; thus, the lubricating oil 9 is separated from the gas cooling medium accommodated in the inside space of the gas-liquid separator 22. The lubricating oil 9 stored in the bottom of the gas-liquid separator 22 is directly returned to the oil storage 10 in the closed container 1 through the connecting pipe 24, while the gas cooling medium is introduced into the closed container 1 via the inner pipe 25 opening to the upper part of the gas-liquid separator 22. Therefore, very little amount of lubricating oil 9 passes through the inner pipe 25 and the succeeding intake gas connecting pipe 11. It means that the amount of the lubricating oil 9 sucked into the compressor mechanism 2 together with gas is surely reduced. Accordingly, it can be surely prevented that the lubricating oil 9 is wasted synergistically. Therefore, it can be surely prevented that the lubricating oil introduced into the refrigerating cycle gives adverse affection to the property of heat exchanger and, thus, refrigerating ability and efficiency of an air-conditioning apparatus will be improved.

Although the inlet chamber 26 is provided for directly connecting the intake gas connecting pipe 11 and the compressor mechanism 2, it is assured that a great amount of oil is not introduced into the inlet chamber 26 because most lubricating oil 9 is separated in the gas-liquid separator 22 and returned to the oil storage 10. Thus the provision of this inlet chamber 26, which is spatially separated from the oil storage 10 as well as the electric motor 7, brings an effect of preventing gas cooling medium from being contaminated by oil of the oil storage 10 and subjected to heat radiation from the electric motor 7. Thus, refrigerating ability is further increased and efficiency of the compressor is more improved.

Even if the amount of liquid-state cooling medium should increase, the gas-liquid separator 22 separates the lubricating oil from gas and returns it to the oil storage 10 through the connecting pipe 24. Therefore, the compression mechanism 2 is far from liquid compression, assuring improved reliability. Liquid-state cooling medium, returned passing through the connecting pipe 24, comes to the vicinity of the electric motor 7 which vaporizes the cooling medium by its radiation heat. Consequently, the electric motor 7 is cooled down efficiently.

Furthermore, fixing the gas-liquid separator 22 close to the closed container 1 of the compressor is effective to vaporize liquid-state cooling medium accumulated in the gas-liquid separator 22 by heat of the compressor. It will suppress the total amount of liquid-state cooling medium returned to the oil storage 10, which will result in realization of compact size.

Figure 2:
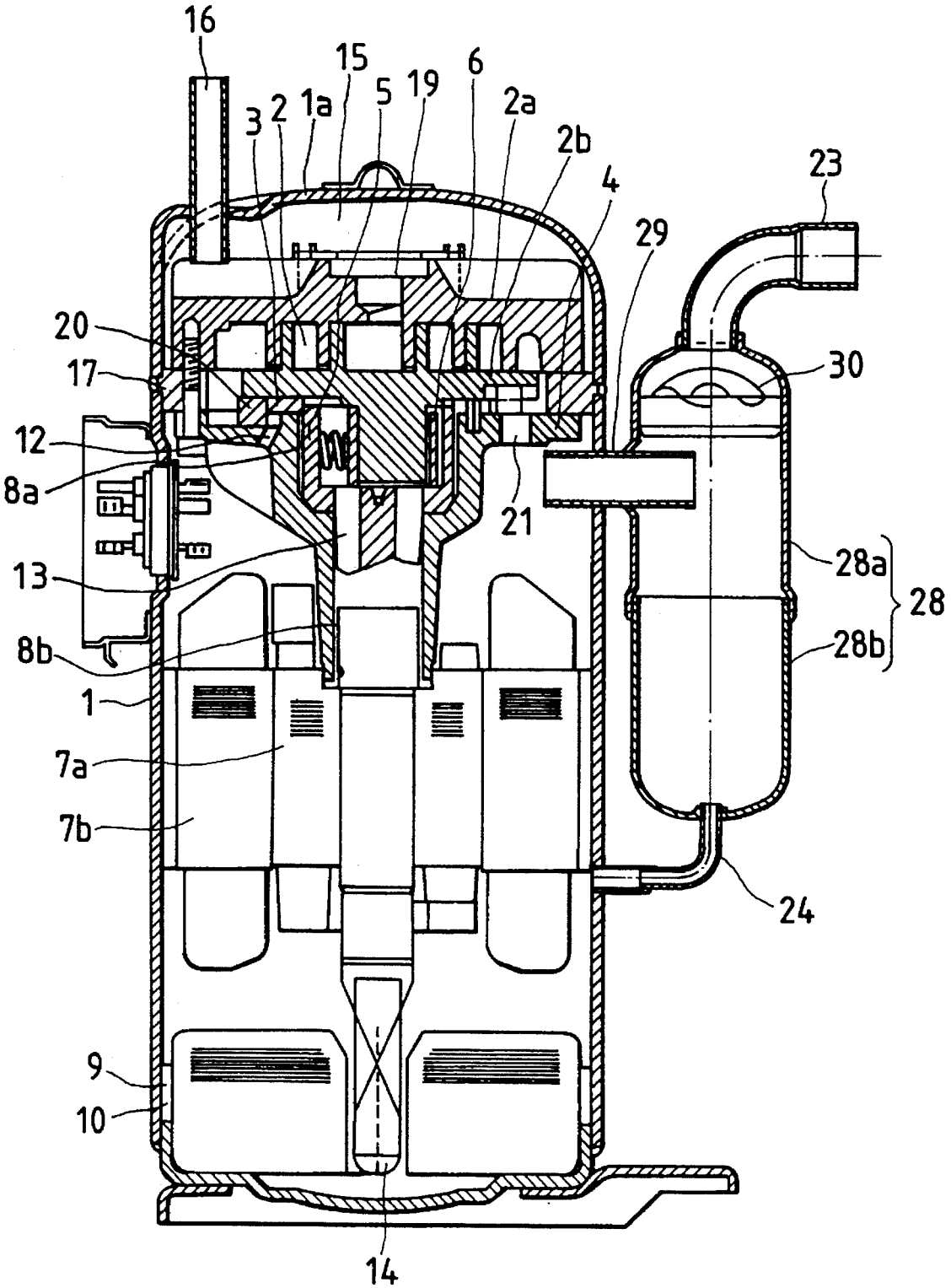
FIG. 2 is a vertical cross-sectional view showing another embodiment of a scroll compressor in accordance with the present invention.
Figure 3:
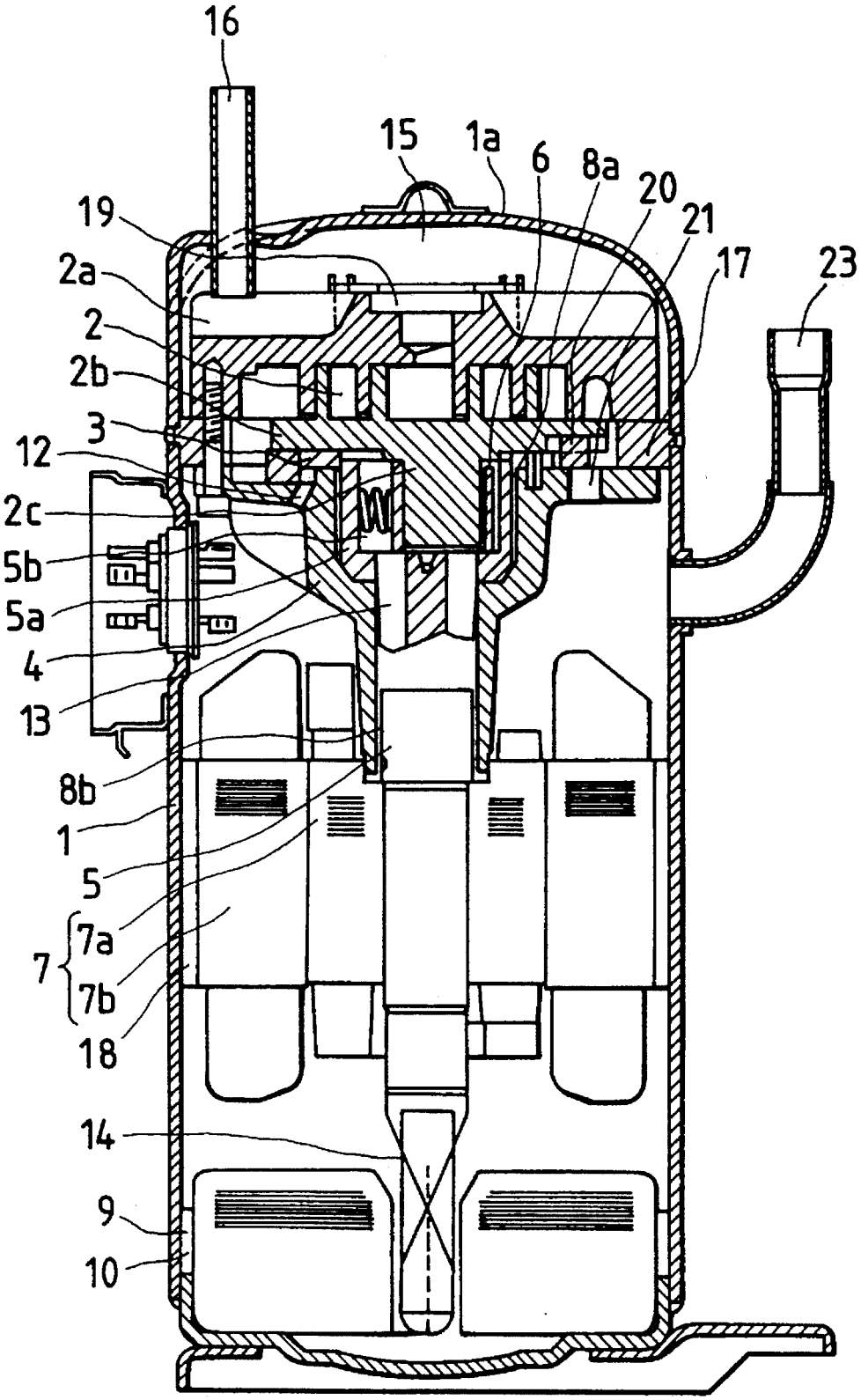
FIG. 3 PRIOR ART
FIG. 3 is a vertical cross-sectional view showing a conventional scroll compressor.

Another embodiment of the present invention will be explained with reference to FIG. 2. Fundamental structure of the compressor is substantially the same as that of FIG. 1, and therefore will be no more explained. In FIG. 2, a gas-liquid separator 28, provided parallel to the closed container 1, has a closed container structure consisting of an upper cup 28*a* and a lower cup 28*b*. The upper cup 28*a* is connected with the intake pipe 23 and an intake gas connecting pipe 29. The intake pipe 23 has its axis, at its open end to the gas-liquid separator 28, aligned in the same direction as the axial direction of the gas-liquid separator 28. The intake gas connecting pipe 29 has one end inserted into the gas-liquid separator 28 and extending perpendicularly to the axial direction of the gas-liquid separator 28 and the other end inserted into the closed container 1 so as to open to the vicinity of the intake port 21 of the bearing member 4. The lower cup 28*b* is connected with the connecting pipe 24, one end of which is opened to the bottom of the gas-liquid separator 28 and the other end of which is opened to the upper space of the oil storage 10 in the vicinity of the electric motor 7 in the closed container 1 of the compressor. Furthermore, there is provided a filter 30 between the intake pipe 23 and the intake gas connecting pipe 29.

When a significant amount of liquid-and-gas state cooling medium returns from the refrigerating cycle, the gas-liquid separator 28 separates it into liquid cooling medium and gas cooling medium. The liquid cooling medium settles in the bottom of the gas-liquid separator 28, while the gas cooling medium is sucked into the compressor mechanism through the intake gas connecting pipe 29. In this case, as the intake gas connecting pipe 29 extends perpendicularly to the axis of the gas-liquid separator 28, flow of the liquid-and-gas state cooling medium returning from the refrigerating cycle is vented perpendicularly at the opening of the intake gas connecting pipe 29; thus liquid cooling medium is blown off away and accordingly efficiency of gas-liquid separation is increased. Cooling medium reserved in the gas-liquid separator 28 goes into the closed container 1 via the connecting pipe 24. Therefore, reserving capacity of the gas-liquid separator 28 is fairly larger than the actual volume of the gas-liquid separator 28 itself. As the intake gas connecting pipe 29 is short and straight, resistance loss of cooling medium flow is minimized and undesirable stay of cooling medium or oil in the pipe can be prevented. Meanwhile, provision of the filter 30 between the intake pipe 23 and the intake gas connecting pipe 29 allows to trap debris or dirt conveyed from the refrigerating cycle at a wider area without increasing flow resistance. In addition, shortness of the intake gas connecting pipe 29 is advantageous in preventing compression of liquid medium by the compressor at the time of starting the compressor since no cooling medium remains in the intake gas connecting pipe 29 during time that the compressor is stopped.

As apparent from the foregoing description, gas cooling medium and the lubricating medium, sent via the outlet pipe 16 out of the closed container 1, circulate in the refrigerating cycle and enter into the gas-liquid separator 22 or 28, wherein the lubricating oil 9 falls due to its gravity and settles in the bottom of the gas-liquid separator 22 or 28, so as to be separated from the gas cooling medium. The lubricating oil 9 stored in the bottom of the gas-liquid separator 22 or 28 is returned via the connecting pipe 24 to the oil storage 10 in the closed container 1. Therefore, it is surely prevented that lubricating oil is mixed with the gas cooling medium. The amount introduced into the compressor mechanism is reduced. Even if the intake port 21 is provided close to the intake gas connecting pipe 11, the amount of oil sucked into the compressor mechanism is not increased synergistically. It results in saving of lubricating oil and, accordingly, reliability is increased.

Furthermore, it is possible thus to oil having an adverse affection to a heat exchanger. An overall effect on of the refrigerating cycle is improved.

Moreover, by providing the inlet chamber 26 so as to directly connect the intake gas connecting pipe 11 to the compressor mechanism 2, it becomes possible to directly introduce gas cooling medium into the compressor mechanism 2 without passing through the inside space of the closed container 1. Thus, it becomes possible to effectively prevent adverse effects due to heat radiation from the electric motor 7 and others. As a result, refrigerating ability is increased and efficiency of compressor is improved. When a great amount of liquid-and-gas state cooling medium returns from the refrigerating cycle, the liquid cooling medium returns to the oil storage 10 through the connecting pipe 24. Therefore, it becomes possible to provide a compressor with increased reliability which is free from liquid compression. As the liquid cooling medium returned in the closed container I cools down the electric motor 7, reliability of the electric motor 7 is also increased.

As this invention may be embodied in several forms without departing from the spirit of essential characteristics thereof, the present embodiments are therefore illustrative and not restrictive, since the scope of the invention is defined by the appending claims rather than by the description preceding them, and all changes that fall within the metes and bounds of the claims, or equivalence of such metes and bounds are therefore intended to be comprehended within the claims.

What is claimed is:

1. A scroll compressor, comprising:

a closed container accommodating compressor means;

said compressor means including a stationary scroll, a movable scroll meshing with said stationary scroll, a crank shaft causing an eccentric revolving motion of said movable scroll with respect to said stationary scroll, and bearing means supporting said crank shaft;

an electric motor associated with said crank shaft, said electric motor including a rotor connected with said crank shaft and a stator secured to said closed container;

an oil storage provided at a lower part of said closed container for reserving lubricating oil;

a gas-liquid separator connected to said closed container;

an intake gas connecting pipe having one end connected to said closed container at a portion spaced from the lower part of said closed container and the other end connected to said gas-liquid separator; and a connecting pipe having one end connected to a bottom part of said gas-liquid separator and the other end connected to the vicinity of said oil storage.

2. A scroll compressor in accordance with claim 1, wherein said one end of the intake gas connecting pipe is located adjacent to an intake port of said compressor means.

3. A scroll compressor in accordance with claim 1, wherein said the other end of connecting pipe is located adjacent to said electric motor.

4. A scroll compressor, comprising:

a closed container accommodating compressor means;

said compressor means including a stationary scroll, a movable scroll meshing with said stationary scroll, a crank shaft causing an eccentric revolving motion of said movable scroll with respect to stationary scroll, and bearing means supporting said crank shaft;

an electric motor associated with said crank shaft, said electric motor including a rotor connected with said crank shaft and a stator secured to said closed container;

an oil storage provided at a lower part of said closed container for reserving lubricating oil;

a gas-liquid separator provided parallel to said closed container;

an intake pipe connected to an upper end of said gas-liquid separator along an axial direction of said gas-liquid separator;

an intake gas connecting pipe having one end connected to said closed container at a portion spaced from the lower part of said closed container and the other end connected to an upper part of said gas-liquid separator, said intake gas connecting pipe extending perpendicularly to an axial direction of said gas-liquid separator; and a connecting pipe having one end connected to a bottom part of said gas-liquid separator and the other end connected to the vicinity of said oil storage.

5. A scroll compressor, comprising:

a closed container accommodating compressor means;

said compressor means including a stationary scroll, a movable scroll meshing with said stationary scroll, a crank shaft causing an eccentric revolving motion of said movable scroll with respect to said stationary scroll, and bearing means supporting said crank shaft;

an electric motor associated with said crank shaft, said electric motor including a rotor connected with said crank shaft and a stator secured to said closed container;

an oil storage provided at a lower part of said closed container for reserving lubricating oil;

a gas-liquid separator provided parallel to said closed container;

an intake pipe connected to an upper end of said gas-liquid separator;

an intake gas connecting pipe having one end connected to said closed container at a portion spaced from the lower part of said closed container and the other end connected to said gas-liquid separator; and a filter provided between said intake pipe and said intake gas connecting pipe.

6. A scroll compressor, comprising:

a closed container having an upper part accommodating compressor means;

said compressor means including a stationary scroll, a movable scroll meshing with said stationary scroll, a crank shaft causing an eccentric revolving motion of said movable scroll with respect to said stationary scroll, and bearing means supporting said crank shaft;

said closed container having a lower part accommodating an electric motor associated with said crank shaft, said electric motor including a rotor connected with said crank shaft and a stator secured to said closed container;

an oil storage provided at the lower part of said closed container for reserving lubricating oil;

a gas-liquid separator fixed to said closed container, said gas-liquid separator having an inner pipe opened to an upper part of said gas-liquid separator;

an intake gas connecting pipe having one end connected to said closed container at a portion spaced from the lower part of said closed container and the other end connected to the inner pipe of said gas-liquid separator;

a connecting pipe having one end connected to a bottom part of said gas-liquid separator and the other end connected to the vicinity of said oil storage.

* * * * *